US006550887B2

(12) United States Patent
Therien et al.

(10) Patent No.: US 6,550,887 B2
(45) Date of Patent: Apr. 22, 2003

(54) INK DROP DETECTOR

(75) Inventors: Patrick J. Therien, Battle Ground, WA (US); Christopher A. Schantz, Redwood City, CA (US)

(73) Assignee: Christopher B. Miller, Palo Alto, CA (US)

( * ) Notice: Subject to any disclaimer, the term of this patent is extended or adjusted under 35 U.S.C. 154(b) by 15 days.

(21) Appl. No.: 09/915,461

(22) Filed: Jul. 25, 2001

(65) Prior Publication Data

US 2003/0020778 A1 Jan. 30, 2003

(51) Int. Cl.[7] ..... B41J 2/165
(52) U.S. Cl. ..... 347/22; 347/81
(58) Field of Search ..... 347/81, 22, 29, 347/33, 32, 19, 14, 23

(56) References Cited

U.S. PATENT DOCUMENTS

| | | | |
|---|---|---|---|
| 6,086,190 A | 7/2000 | Schantz et al. | 347/81 |
| 6,454,373 B1 | 9/2002 | Therien et al. | 347/1 |
| 6,454,374 B1 | 9/2002 | Therien | 347/1 |

*Primary Examiner*—Shih-Wen Hsieh
(74) *Attorney, Agent, or Firm*—Christopher B. Miller

(57) ABSTRACT

An apparatus for detecting ink droplets ejected from ink drop generators has a target holder and a conductive absorbent target supported by the target holder. The apparatus for detecting ink droplets also has standoffs extending from the target holder. The apparatus for detecting ink droplets further has an actuator for moving the target holder towards the ink drop generators such that the standoffs space the target from the ink drop generators.

24 Claims, 9 Drawing Sheets

INK DROP DETECTOR

The present invention relates generally to printing mechanisms, such as inkjet printers or inkjet plotters. Printing mechanisms often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains linear arrays of heater elements, such as resistors, which are individually addressable and energized to heat ink within the vaporization chambers. Upon heating, an ink droplet is ejected from a nozzle associated with the energized resistor. The inkjet printhead nozzles are typically, aligned in one or more linear arrays substantially parallel to the motion of the print media as the media travels through the printzone. The length of the linear nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism may achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle," in the print media that a single pass swath would cause.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that the drop size, relative position of the ink drops, and color of a small, discreet number of process inks are integrated by the naturally occurring visual response of the human eye to produce the effect of a large colorspace with millions of discernable colors and the effect of a nearly continuous tone. In fact, when these imaging techniques are performed properly by those skilled in the art, near-photographic quality images can be obtained on a variety of print media using only three to eight colors of ink.

This high level of image quality depends on many factors, several of which include: consistent and small ink drop size, consistent ink drop trajectory from the printhead nozzle to the print media, and extremely reliable inkjet printhead nozzles which do not clog.

To this end, many inkjet printing mechanisms contain a service station for the maintenance of the inkjet printheads. These service stations may include scrapers, ink-solvent applicators, primers, and caps to help keep the nozzles from drying out during periods of inactivity. Additionally, inkjet printing mechanisms often contain service routines which are designed to fire ink out of each of the nozzles and into a waste spittoon in order to prevent nozzle clogging.

Despite these preventative measures, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead scrapers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged or failed printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a number of different ink drop detector systems.

One type of ink drop detector system utilizes a piezo-electric target surface that produces a measurable signal when ink droplets contact the target surface. Unfortunately, however, this type of technology is expensive and often is unable to detect the extremely small drops of ink used in inkjet printing systems with photographic image quality.

Another type of ink drop detector utilizes an optical sensor which forms a measurable signal when an ink droplet passes through a light beam from a sensory circuit. Unfortunately, this method is subject to extremely tight alignment tolerances which are difficult and expensive to setup and maintain. Additionally, an optical ink drop detection system is susceptible to the ink aerosol which results from the firing of the inkjet printhead inside of the printing mechanism. The aerosol coats the optical sensor over time, degrading the optical sensor signal and eventually preventing the optical sensor from functioning.

A more effective solution for ink drop detection is to use a low cost ink drop detection system, such as the one described in U.S. Pat. No. 6,086,190 assigned to the present assignee, Hewlett-Packard Company. This drop detection system utilizes an electrostatic sensing element which is imparted with an electrical stimulus when struck by a series of ink drop bursts ejected from an inkjet printhead. The electrostatic sensing element may be made sufficiently large so that printhead alignment is not critical, and the sensing element may function with amounts of ink or aerosol on the sensing element surface which would incapacitate other types of drop detection sensors.

In practical implementation, however, this electrostatic sensing element has some limitations. First, successive drops of ink, drying on top of one another quickly form stalagmites of dried ink which may grow toward the printhead. Since it is preferable to have the electrostatic sensing element very close to the printhead for more accurate readings, these stalagmites may eventually interfere with or permanently damage the printhead, adversely affecting print quality. Second, as the ink residue dries, it remains conductive and may short out the drop detector electronics as the ink residue grows and spreads. Thus, this dried ink residue may impair the ability of the sensor to measure ink drop characteristics properly. Third, a build-up of dried ink on the sensor may decrease the measurement gap, adversely affecting the drop measurement signal. Fourth, current ink drop sensors may be sensitive to spacing variations, inherent in a printing mechanism, from the printheads to the sensor.

Therefore, it is desirable to have an economical method and mechanism for ink drop detection which is less susceptible to waste ink residue build-up and which is able to minimize the measurement spacing variability inherent in current printing mechanisms which utilize ink drop detection systems.

DETAILED DESCRIPTION OF THE PREFERRED EMBODIMENTS

Figure 1:
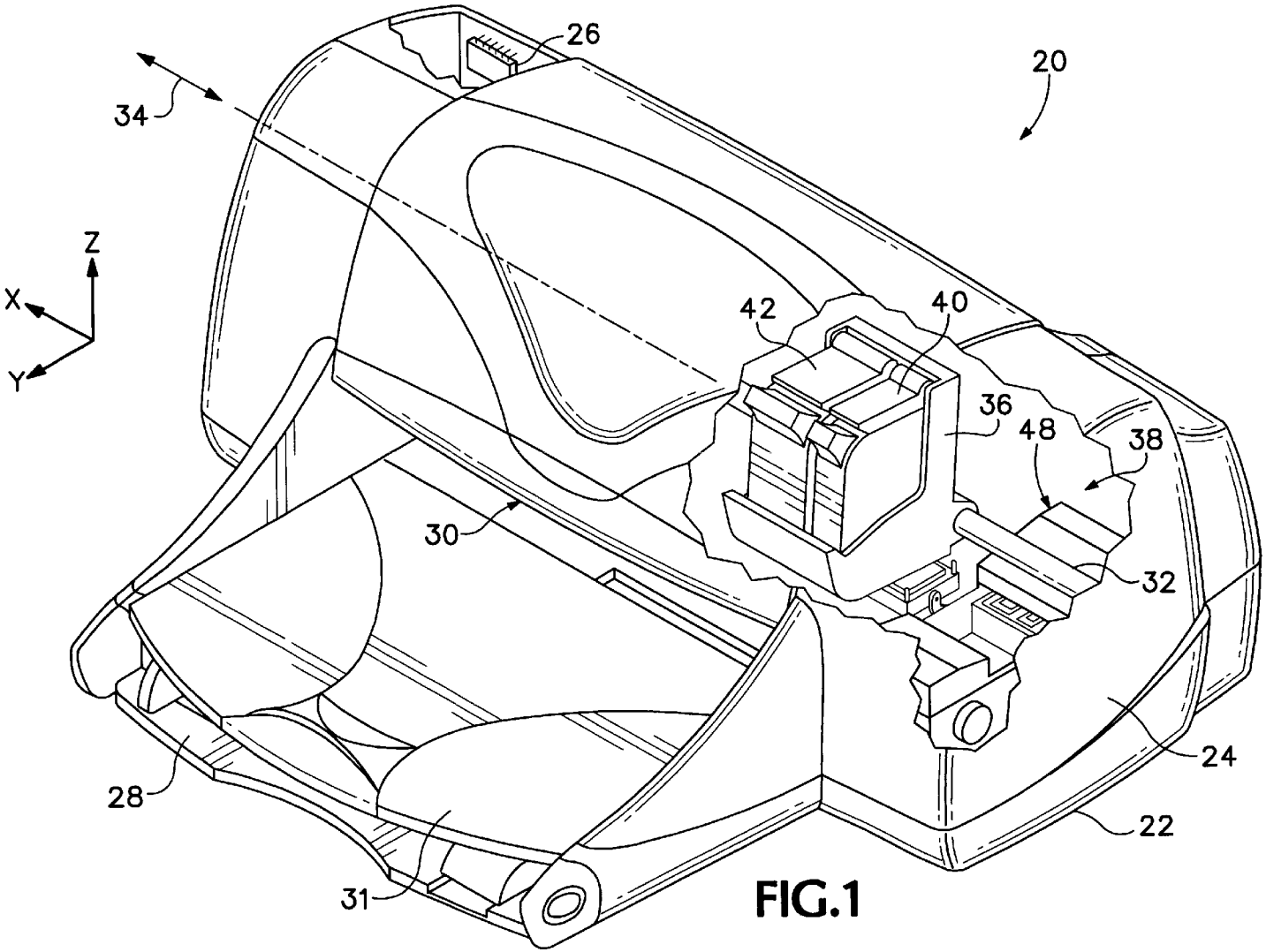
FIG. 1 is a fragmented perspective view of one form of an inkjet printing mechanism, here illustrating a service station which includes an embodiment of an electrostatic ink drop detector.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or others environment. A variety of inkjet printing mechanisms are commercially available. For instance, some of the printing mechanisms that may embody the concepts described herein include desk top printers, portable printing units, wide-formt printers, hybrid electrophotographic-inkjet printers, copiers, cameras, video printers, and facsimile machines, to name a few. For convenience the concept introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instruction from a host device, such as a computer or personal data assistant (PDA) (not shown). A screen coupled to the host device may also be used to display visual information to an operator, such as the printer status or a particular program beign run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media (not shown) from the media input tray 28 through a printzone 30 and to an output tray 31. A carriage guide rod 32 is mounted to the chassis 22 to define a scanning axis 34, with the guide rod 32 slideably supporting an inkjet carriage 36 for travel back and forth, reciprocally, across the printzone 30. A conventional carriage drive motor (not shown) may be used to propel the carriage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader, may also be accomplished in a variety of ways known to those skilled in the art.

In the printzone 30, the media sheet receives ink from an inkjet cartridge, such as a black ink cartridge 40 and a color inkjet cartridge 42. The cartridges 40 and 42 are also often called "pens" by those in the art. The black ink pen 40 is illustrated herein as containing a pigment-based ink. For the purposes of illustration, color pen 42 is described as containing three separate dye-based inks which are colored cyan, magenta, and yellow, although it is apparent that the color pen 42 may also contain pigment-based inks in some implementations. It is apparent that other types of inks may also be used in the pens 40 and 42, such as paraffin-based inks, as well as hybrid or composite inks having both dye and pigment characteristics. The illustrated printer 20 uses replaceable printhead cartridges where each pen has a reservoir that carries the entire ink supply as the printhead reciprocates over the printzone 30. As used herein, the term "pen" or "cartridge" may also refer to an "off-axis" ink delivery system, having main stationary reservoirs (not shown) for each ink (black, cyan, magenta, yellow, or other colors depending on the number of inks in the system) located in an ink supply region. In an off-axis system, the pens may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as "snapper" cartridges which have ink reservoirs that snap onto permanent or semi-permanent print heads.

The illustrated black pen 40 has a printhead 44, and color pen 42 has a tri-color printhead 46 which ejects cyan, magenta, and yellow inks. The printheads 44, 46 selectively eject ink to from an image on a sheet of media when in the printzone 30. The printheads 44, 46 each have an orifice plate with a plurality of nozzles formed therethrough in a manner well known to those skilled in the art. The nozzles of each printhead 44, 46 are typically formed in at least one, but typically a plurality of linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 34, with the length of each array determining the maximum image swath for a single pass of the printhead. The printheads 44, 46 are thermal inkjet printheads, although other types of printheads may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media when in the printzone 30 under the nozzle. The printhead resistors are selectively energized in response to firing command control signals delivered from the controller 26 to the printhead carriage 36.

Between print jobs, the inkjet carriage 36 moves along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

Figure 2:
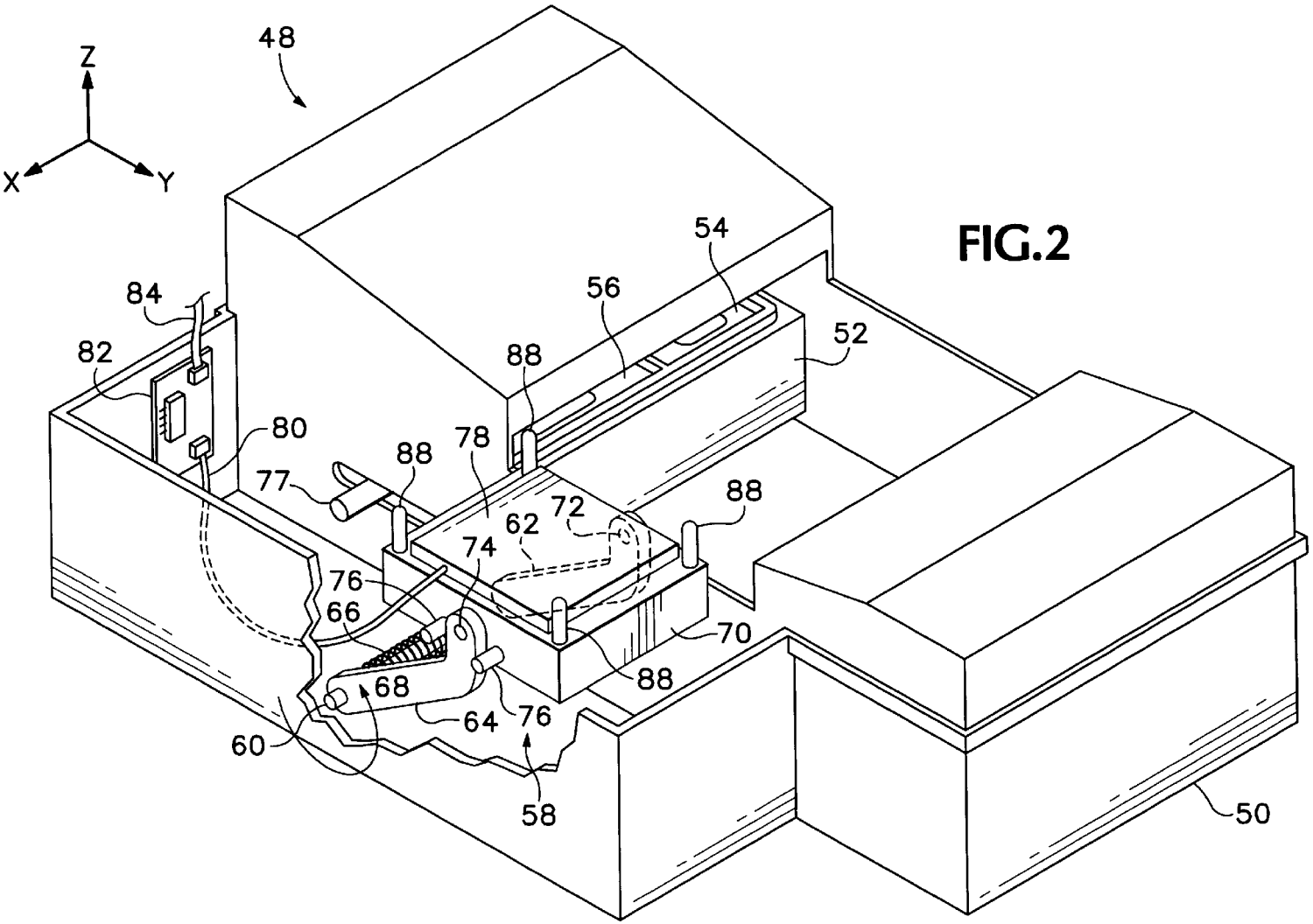
FIG. 2 is an enlarged, fragmented perspective view of the service station of FIG. 1

FIG. 2 shows the service station 48 in detail. A service station frame 50 is mounted to the chassis 22, and houses a moveable pallet 52. The moveable pallet 52 may be driven by a motor (not shown) to move in the frame 50 in the positive and negative Y-axis directions. The moveable pallet 52 may be driven by a rack and pinion gear powered by the service station motor in response to the microprocessor 26 according to methods known by those skilled in the art. An example of such a rack and pinion system in an inkjet cleaning service station can be found in U.S. Pat. No. 5,980,018, assigned to the Hewlett-Packard Company, also the current assignee. The end result is that pallet 52 may be moved in the positive Y-axis direction to a servicing position and in the negative Y-axis direction to an uncapped position. The pallet 52 supports a black printhead cap 54 and a tri-color printhead cap 56 to seal the printheads 44 and 46, respectively, when the moveable pallet 52 is in the servicing position, here a capping position.

FIG. 2 also shows an ink drop detector 58 supported by a pivot post 60 which is connected to frame 50. Interior linkage arm 62 and exterior linkage arm 64 rotate about pivot post 60. A spring element, such as torsion spring 66 is attached between pivot post 60 and either of the linkage arms 62, 64. The spring 66 imparts a rotational force on the linkage arm 62 or 64 which it is connected to, in a counter-clockwise rotational direction 68. The linkage arms 62, 64 support a target holder 70 at interior target pivot point 72 and exterior target pivot point 74, respectively.

As the rotational angle of the linkage arms 62, 64 is varied around pivot point 60, the target holder 70 is free to rotate on target pivot points 72, 74 within a range determined by anti-rotation nubs 76 which extend outward in the positive X-axis direction from target holder 70 on either side of exterior linkage arm 64. When the target holder 70 reaches certain angles with respect to linkage arm 64, the anti-rotation nubs 76 interfere with the exterior linkage arm 64 and prevent further rotation of the target holder 70 with respect to the exterior linkage arm 64.

The linkage arms 62, 64 rotate in the counter-clockwise direction 68 until interior linkage arm 72 contacts a pallet arm 77 which is supported by the moveable pallet 52, and which extends outwardly in the positive X-axis direction from the moveable pallet 52. For illustration purposes, the linkage arms 62, 64 are not shown in contact with the pallet arm 77 in FIG. 2 so that the pallet arm 77 may be clearly seen. In normal operation, however, the linkage arms would rotate in a counter-clockwise direction 68 and stop when contact with the pallet arm 77 occurs.

Target holder 70 supports a conductive absorbent electrostatic sensing element, or "target" 78, on the upper side onto which ink droplets may be fired and detected according to the apparatus and method described in U.S. Pat. No. 6,086,190, assigned to the Hewlett-Packard Company, the present assignee. Target 78 may be constructed by using a foam pad which is pretreated with a conductive solvent such as glycerol or polyethylene glycol (PEG). Other absorbent materials may similarly be selected depending on design or cost restraints, for example, the target 78 could be constructed of polyurethane or a rigid and porous sintered plastic. Conductor 80 connects the target 78 to an electrostatic drop detect printed circuit board assembly (PCA) 82. The PCA 82 contains various electronics (not shown) for filtering and amplification of drop detection signals received from the target 78 via conductor 80. An additional electrical conductor 84 links the PCA 82 to controller 26 for drop detection signal processing. Although PCA 82 is illustrated as supported by the service station frame 50, PCA 82 may be located elsewhere inside of the printer 20 to accommodate design goals such as sharing PCA real estate with other circuitry or removing the PCA 82 from the vicinity of conductive ink residue and ink aerosol.

Figure 3:
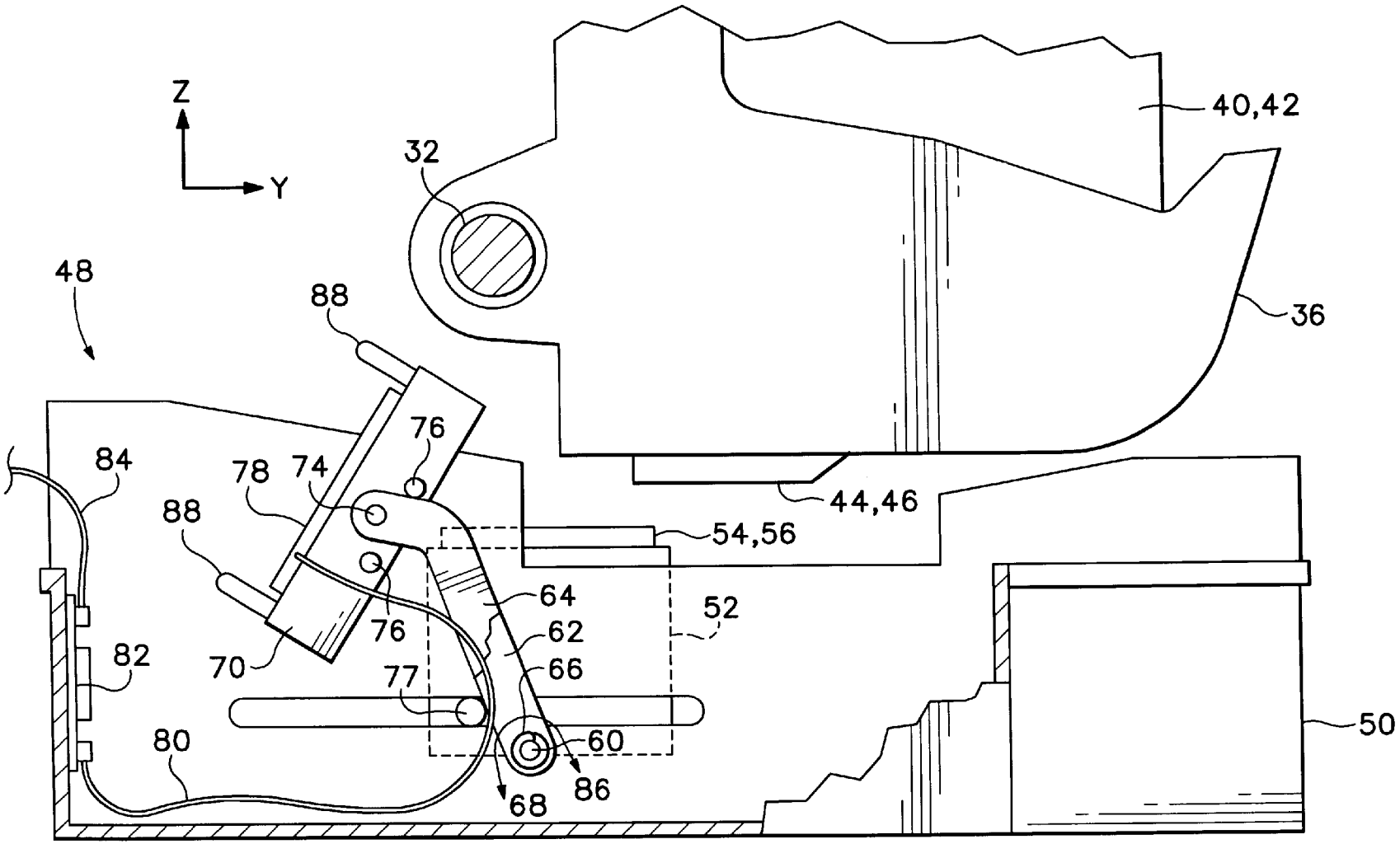
FIG. 3 is an enlarged, fragmented side elevational view of the service station of FIG. 1 shown with a servicing sled in a retracted position.
Figure 4:
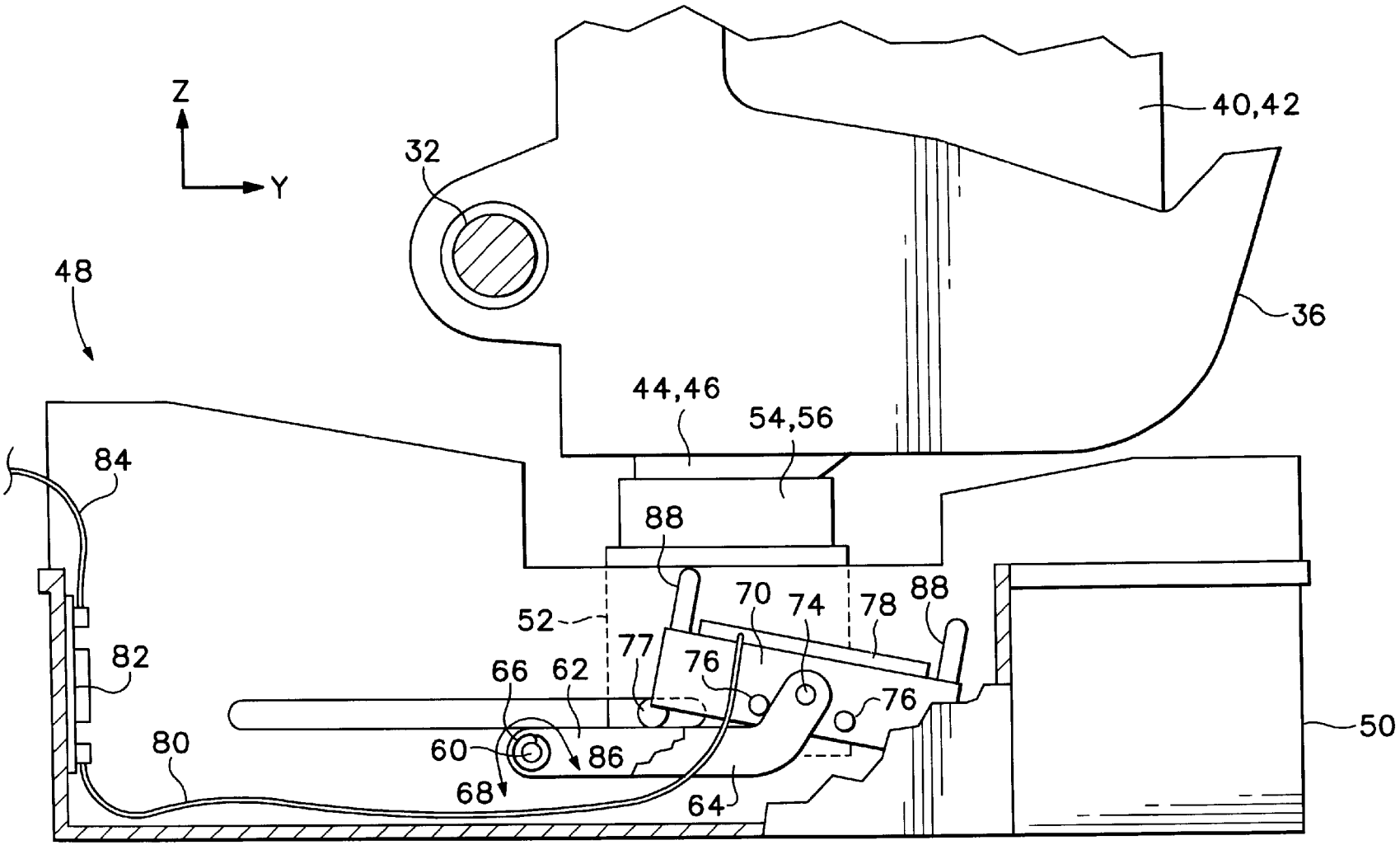
FIG. 4 is an enlarged, fragmented side elevational view of the service station of FIG. 1 shown with a servicing sled in a servicing position.

FIG. 3 shows servicing pallet 52 in a retracted position. While the pallet 52 is retracted, the linkage arms 62, 64 are positioned against pallet arm 77 such that the linkage arms 62, 64 and the target holder 70 are in a non-measurement position which allows printhead carriage 36 to be moved freely along carriage guide rod 32 between the printzone 30 and the servicing region 38. When the carriage 36 is in the servicing region 38, it is aligned over the service station 48, where printheads 44, 46 may be serviced, for example, by spitting ink into the service station. Movement in a clockwise direction 86, is imparted to the linkage arms 62, 64 by pallet arm 77 when servicing pallet 52 is moved in the positive Y-axis direction. As the pallet 52 continues to move in the positive Y-axis direction, the servicing pallet 52 moves from the retracted position in FIG. 3 to a servicing position shown in FIG. 4. When the servicing pallet 52 is in the servicing position, the linkage arms 62, 64 are fully rotated in the clockwise direction 86, holding target holder 70 in a pre-measurement position.

When the pallet 52 is moved to the servicing position, the black printhead cap 54 and color printhead cap 56 lift off of the servicing pallet 52 to engage and cap the black printhead 44 and the tri-color printhead 46, respectively. A servicing mechanism capable of engaging the printheads in this manner is disclosed in U.S. Pat. No. 5,980,018, also assigned to the present assignee, the Hewlett-Packard Company. For simplicity of illustration, caps 54, 56 are shown schematically in FIG. 4 as rising up to engage printheads 44, 46 when the servicing pallet 52 is in the servicing position. In this manner, the pallet 52 may be moved between the retracted position and the servicing position to perform various printhead 44, 46 servicing techniques well-known to those skilled in the art.

Figure 5:
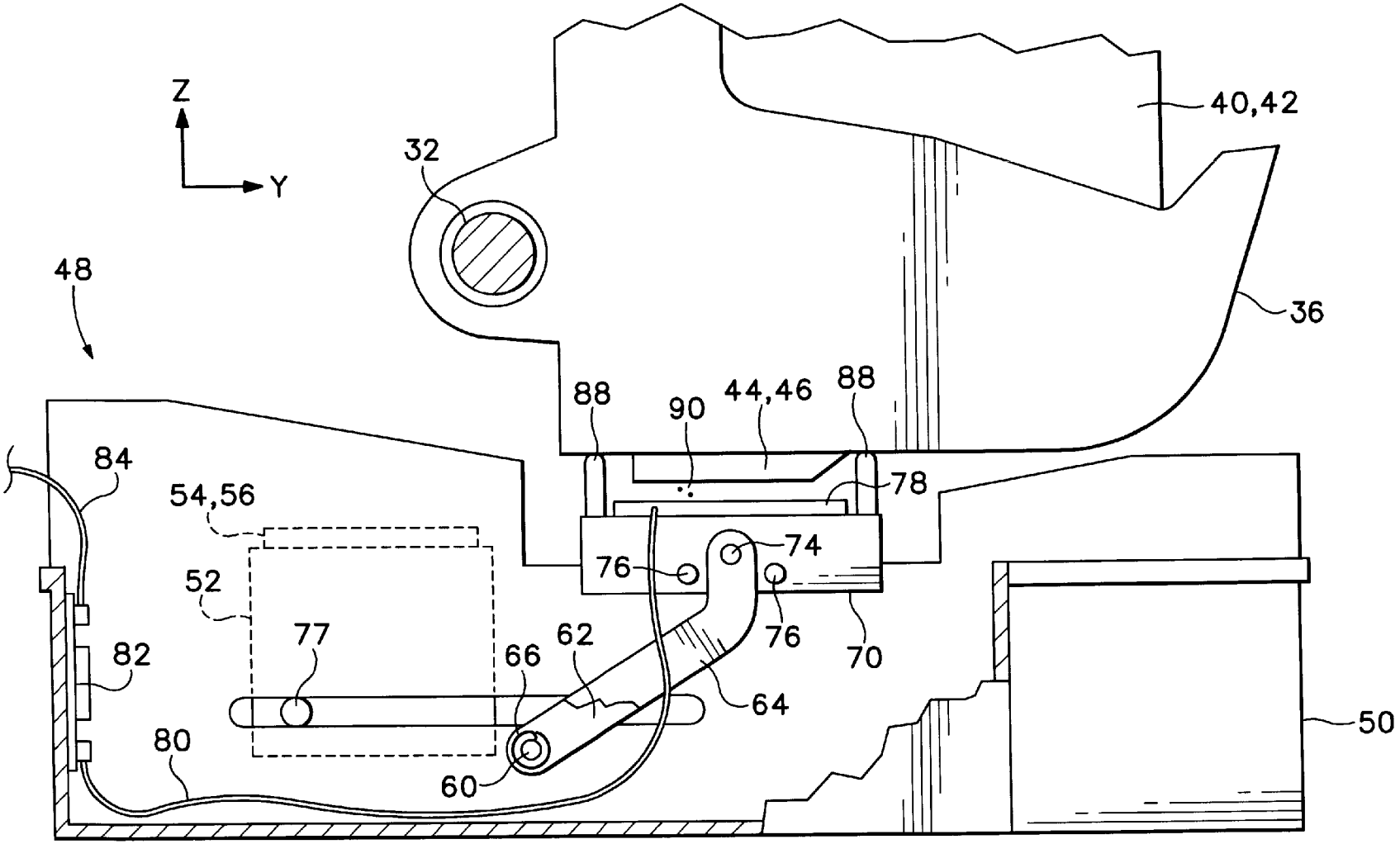
FIG. 5 is an enlarged, fragmented side elevational view of the service station of FIG. 1 shown with an ink drop detection target in a measurement position.

When printhead 44, 46 servicing is complete, the pallet 52 is moved to the retracted position shown in FIG. 3 and the spring 66 rotates the linkage arms 62, 64 and the target holder 70 in the counter-clockwise direction 68 into the non-measurement position. At this point, the printhead carriage 36 is free to move in the positive X-axis direction to the printzone 30 for printing if desired. Once the printhead carriage 36 is clear of the servicing region 38, the target holder 70 may be moved back into the pre-measurement position by moving the servicing pallet 52 from the retracted position back to the servicing position shown in FIG. 3. At this point, the printhead carriage 36 may be moved back in the negative X-axis direction to align either black printhead 44 or tri-color printhead 46 over conductive absorbent target 78. Once the printhead 44, 46 is properly positioned, the servicing pallet 52 is moved back to the retracted position. As pallet 52 retracts, linkage arms 62, 64 and target holder 70 rotate in the counter-clockwise direction 68 until target standoffs 88 engage the printhead 44, 46 as is illustrated in FIG. 5.

The standoffs 88 control the spacing from the printheads 44, 46 to the electrostatic target 78, commonly referred to as "Pen to Electrostatic drop detector in the Z-direction (PEZ) spacing" by those in the art. Although four standoffs 88 are illustrated, three or more standoffs 88 could be used. A typical PEZ spacing is on the order of 2.0 millimeters. Targets which may be attached to the printer frame 22, or the service station frame 50, and which do not locate to the printheads 44, 46 may create a substantial tolerance stack among the many parts between such a non-locating target and the printheads 44, 46. Such a tolerance stack could introduce a variation of plus or minus 1.0 millimeters on top of the desired 2.0 mm PEZ. Such variation threatens printhead reliability on the low end of 1.0 millimeters by increasing the risk of handing off fibers and ink residue from the non-locating target to the printheads 44, 46. At the high end of 3.0 millimeters, although the printhead reliability risk is reduced, ultra-small ink drops, in the range of approximately two to three picoliters, may reach terminal velocity well before they hit this non-locating target. If a drop reaches terminal velocity, then it is possible the drop may be more influenced by convection currents and turbulence to the extent that the ink drops may be driven off course and miss the non-locating target entirely. Therefore, it is advantageous to employ target standoffs 88 in the embodiment of FIG. 5 to control the PEZ spacing with a minimum amount of tolerance variation between the printheads 44, 46 and the electrostatic target 78.

Once the printhead 44, 46 is properly spaced from the electrostatic target 78, the controller 26 causes ink droplets 90 to be fired from printhead 44, 46 onto the target 78. An electrical drop detect signal is generated by the ink droplets 90 as they contact the target 78, and this signal is captured by the electronics of electrostatic drop detector PCA 82. The drop detect signal is then analyzed by controller 26 to determine whether or not various nozzles of printhead 44, 46 are spitting ink properly or whether they are clogged. A preferred method of analyzing signals from an electrostatic target ink drop detector is shown in U.S. Pat. No. 6,086,190, also assigned to the present assignee, the Hewlett-Packard Company. Based on the determination made by the controller 26 as to whether each nozzle is functioning properly, the controller 26 may adjust the print masks to substitute functioning nozzles for any malfunctioning nozzles to provide consistent high-quality printed output while still using a printhead with permanently clogged nozzles.

In order to ensure that a reliable measurement may be made by the ink drop detector 58, it is desirable to prevent the build-up of dried ink deposits on the target 78 after a measurement or series of measurements have been made. Conductive absorbent target 78 is pretreated with a conductive solvent which is selected to dissolve and absorb the ink droplets 90 which contact the target 78, thereby reducing the likelihood that ink deposits may accumulate over time. Thus, the embodiment of an electrostatic drop detection system illustrated in FIGS. 2–5 may be constructed without additional hardware to clean and scrape the target 78 while still having long life and high reliability.

After the desired number of drop detection measurements are taken, the servicing pallet 52 may then be moved in the positive Y-axis direction to the servicing position. The target standoffs 88 disengage the printheads 44, 46, and linkage arms 62, 64 and target holder 70 moves to the forward pre-measurement position. The printhead carriage 36 may then be moved in the positive X-axis direction towards the printzone 30, and then pallet 52 may be moved in the negative Y-axis direction to the retracted position of FIG. 3. When the pallet 52 is in the retracted position of FIG. 3, the linkage arms 62, 64 and target holder 70 are in the non-measurement position, and the printhead carriage 36 is free at this point to move back to the servicing region 38 or to print in the printzone 30.

Clearly, the ink drop detector 58 could be mounted in other locations along the printhead scanning axis 34, including the right side of the service station frame 50 or the opposite end of the printer from the service station 48. Additionally, alternate structures for bringing the target standoffs 88 into contact with the printheads 44, 46 will be readily apparent to those skilled in the art, such as, for example, a solenoid activated spring mechanism which may translate the target holder 70 substantially parallel to the Z-axis, thereby bringing the standoffs 88 into and out of contact with the printheads when drop detection measurements are desired.

Figure 6:
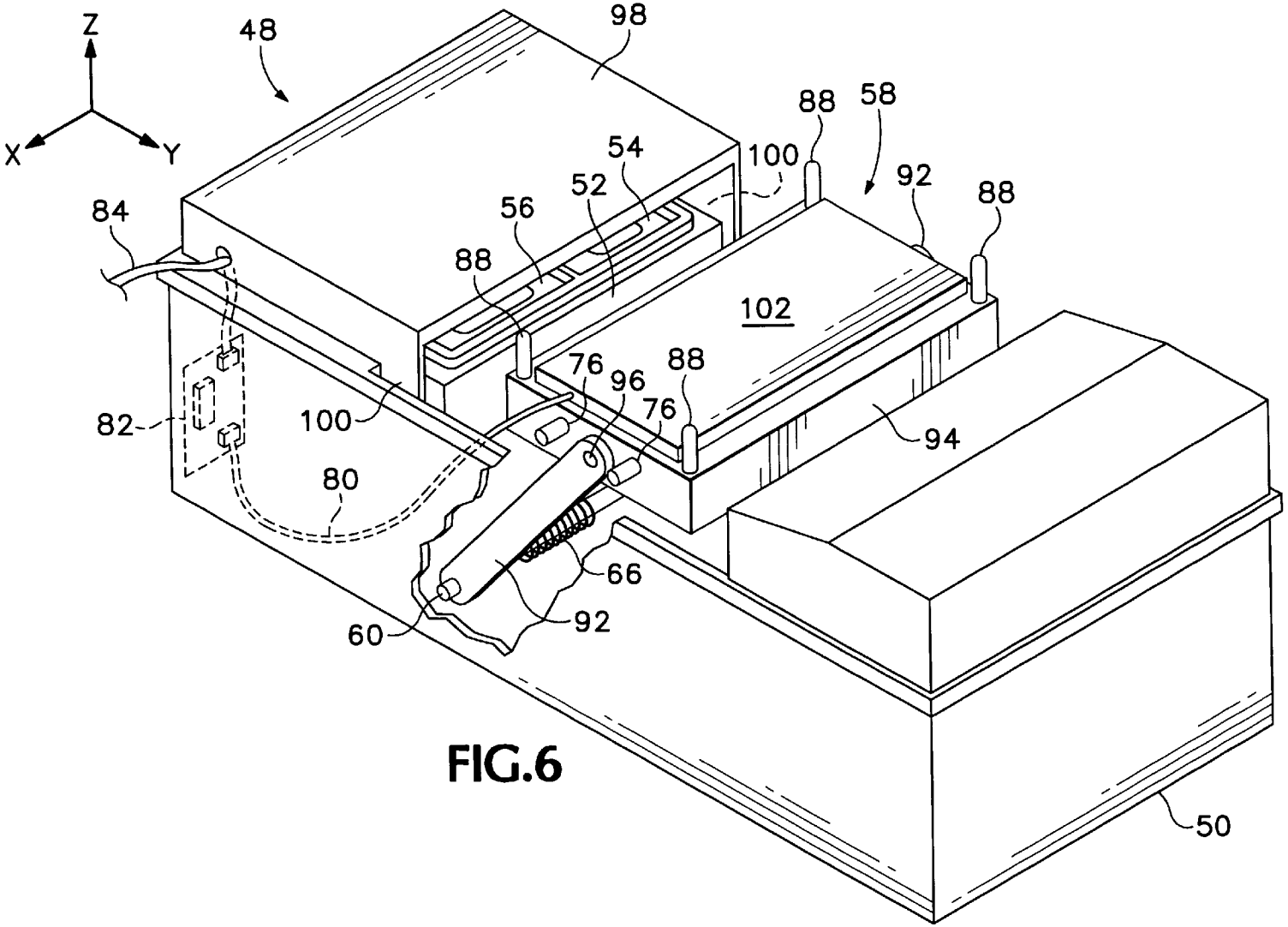
FIG. 6 is an enlarged perspective view illustrating a service station similar to the service station in FIG. 2, but having an alternative embodiment of an electrostatic ink drop detector.

FIG. 6 illustrates an alternate embodiment of an electrostatic drop detector 58, here shown located inside of the service station 48, and substantially inline with the servicing pallet 52. The drop detection system 58 has linkage arms 92 which pivot about pivot post 60. The linkage arms 92 support target holder 94 at target pivot points 96. The service station 48 has a bonnet 98 which is attached to the top of service station frame 50, and which covers portions of the service station 48 to protect the servicing elements and to help control the flow of aerosol. The bonnet 98 may additionally be formed to create linkage arm clearance channels 100 on either side of the bonnet 98 between the bonnet 98 and the service station frame 50.

Target holder 94 supports a conductive absorbent electrostatic sensing element, or "target" 102, on the upper side onto which ink droplets may be fired and detected according to the apparatus and method described in U.S. Pat. No. 6,086,190, assigned to the Hewlett-Packard Company, the present assignee. Target 102, like target 78, may be constructed by using a foam pad which is pretreated with a conductive solvent such as glycerol or polyethylene glycol (PEG). Other absorbent materials may similarly be selected depending on design or cost restraints, for example, the target 102 could be constructed of polyurethane or a rigid and porous sintered plastic. Conductor 80 connects the target 102 to an electrostatic drop detect printed circuit board assembly (PCA) 82. The PCA 82 contains various electronics (not shown) for filtering and amplification of drop detection signals received from the target 102 via conductor 80. An additional electrical conductor 84 links the PCA 82 to controller 26 for drop detection signal processing. Although PCA 82 is illustrated as supported by the service station frame 50, PCA 82 may be located elsewhere inside of the printer 20 to accommodate design goals such as sharing PCA real estate with other circuitry or to remove the PCA 82 from the vicinity of conductive ink residue and ink aerosol.

Figure 7:
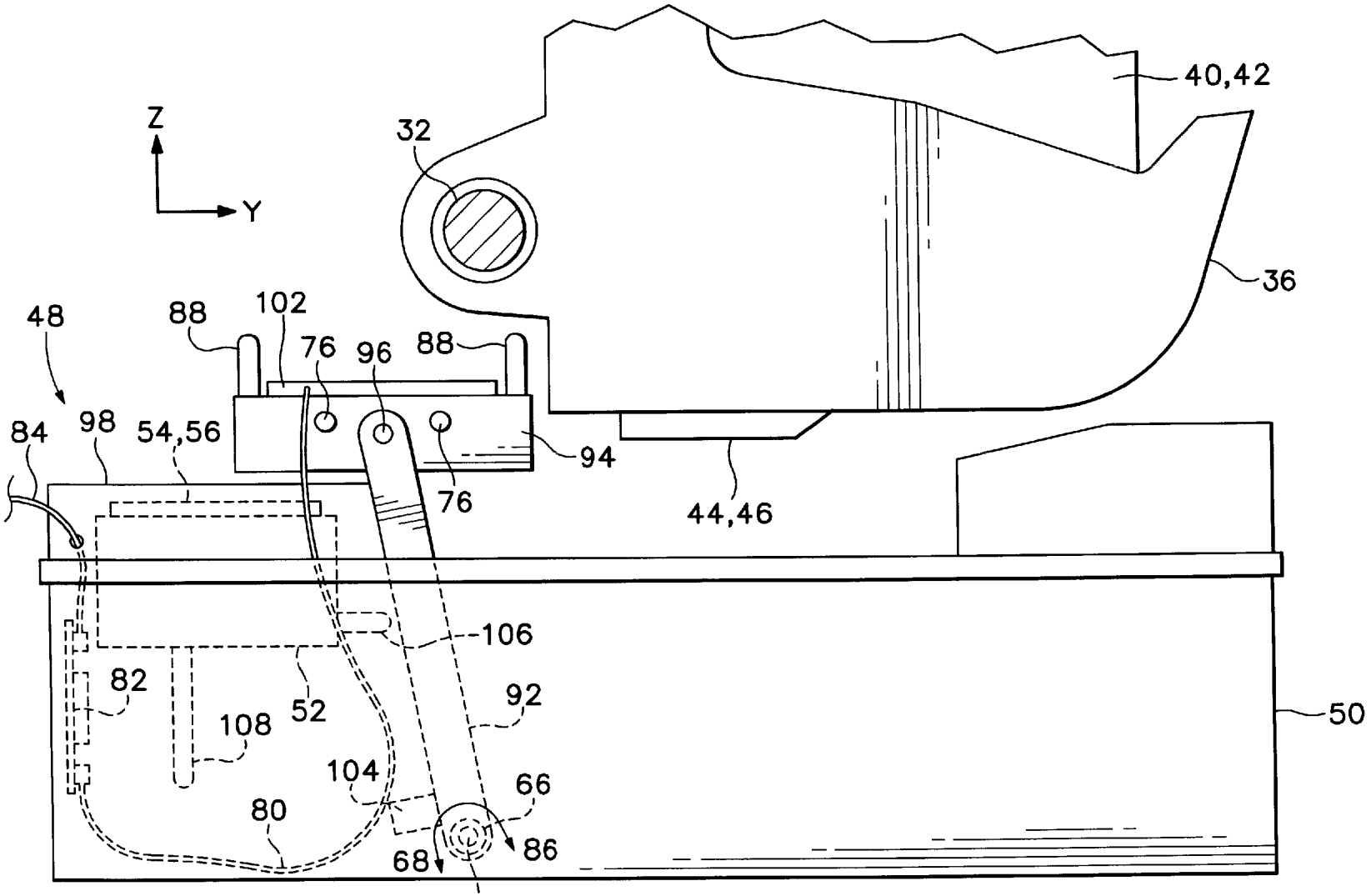
FIG. 7 is an enlarged side elevational view of the service station of FIG. 6, shown with a servicing sled in a retracted position.

FIG. 7 shows the service station 48 and electrostatic drop detector 58 of FIG. 6 in a side elevational view. Servicing pallet 52 is shown in a retracted position. The linkage arms 92 and target holder 94 are biased in counterclockwise direction 68 around pivot post 60 by biasing spring element 66. A hard stop 104 is provided to limit the range of motion of linkage arms 92 when rotating in the counter-clockwise direction 68. As illustrated in FIG. 7, with linkage arms 92 at rest against a hard stop 104, the target holder 94 and linkage arms 92 are in a rearward non-measurement position. The linkage arms 92 are able to clear the bonnet 98 by passing through linkage arm clearance channels 100 while in this rearward non-measurement position.

If it is only desired to spit ink from the printheads 44, 46 into the service station 48, for example during a print job to make sure all of the nozzles are clear, the print carriage 36 is free to move along carriage guide rod 32 in the negative X-axis direction until the printheads 44, 46 are positioned over the service station 48 when the servicing pallet 52 is in the retracted position. In order to be able to service the printheads 44, 46 with the servicing pallet 52, the print head carriage 36 must be moved along carriage guide rod 32, towards the printzone 30, in order to provide clearance for the target holder 94 and target standoffs 88 when the servicing pallet begins to move in the positive Y-axis direction into a servicing position.

Protruding in the positive Y-axis direction from the front of pallet 52 is a front pallet arm 106. When the printhead carriage 36 is out of the way, servicing pallet 52 may be moved in the positive Y-axis direction, causing front pallet arm 106 to contact linkage arms 92. The linear motion force of pallet 92 is greater than the rotational force applied by spring element 66 onto linkage arms 92, causing linkage arms 92 to rotate in the clockwise direction 86 around the pivot post 60. The anti-rotation nubs 76 protrude outwardly from the target holder 94 on either side of the linkage arms 92, but not so far as to interfere with the service station frame 50. If the target holder 94 is rotated around target pivot point 96 far enough, the anti-rotation nubs 76 will contact the linkage arms 92, preventing further rotation of the target holder,94 around the target pivot points 96.

The servicing pallet 52 is momentarily stopped in a pre-servicing position when it has moved far enough in the positive Y-axis direction to have rotated the linkage arms 92 and target holder 94 in the clockwise direction 86 out of the path traveled by the printhead carriage 36. While the pallet 52 is in this pre-servicing position, the printhead carriage 36 may be moved in the negative X-axis direction until the printheads 44, 46 are over the service station 48. When the printheads 44, 46 are in position over the service station 48, the pallet 52 may be moved further in the positive Y-axis direction. As the pallet 52 moves towards the servicing position shown in FIG. 8, a lower pallet arm 108 comes into contact with the linkage arms 92, pushing the linkage arms 92 away from the front pallet arm 106 and further down into the service station 48 as linkage arms 92 are rotated around pivot post 60 in the clockwise direction 86. When the servicing pallet 52 reaches the servicing position of FIG. 8, the linkage arms 92 are fully rotated in the clockwise direction 86.

When the pallet 52 is moved to the servicing position, the black printhead cap 54 and color printhead cap 56 lift off of the servicing pallet 52 to engage and cap the black printhead 44 and the tri-color printhead 46, respectively. A servicing mechanism capable of engaging the printheads in this manner is disclosed in U.S. Pat. No. 5,980,018, also assigned to the present assignee, the Hewlett-Packard Company. For simplicity of illustration, caps 54, 56 are shown schematically in FIG. 8 as rising up to engage printheads 44, 46 when the servicing pallet 52 is in the servicing position. In this manner, the pallet 52 may be moved between the retracted position and the servicing position to perform various printhead 44, 46 servicing techniques well-known to those skilled in the art.

When printhead 44, 46 servicing is complete, the pallet 52 may be withdrawn in the negative Y-axis direction and paused in the pre-servicing position to allow the printhead carriage 36 to move in the positive X-axis direction to the printzone 30. When the printhead carriage 36 clears the service station 48, the servicing pallet 52 may be completely withdrawn in the negative Y-axis direction until it reaches the retracted position shown in FIG. 7. The spring element 66 rotates the linkage arms 92 in counterclockwise direction 68 around pivot post 60 as the pallet 52 is withdrawn, thereby also returning the target holder 94 to the rearward non-measurement position.

Figure 8:
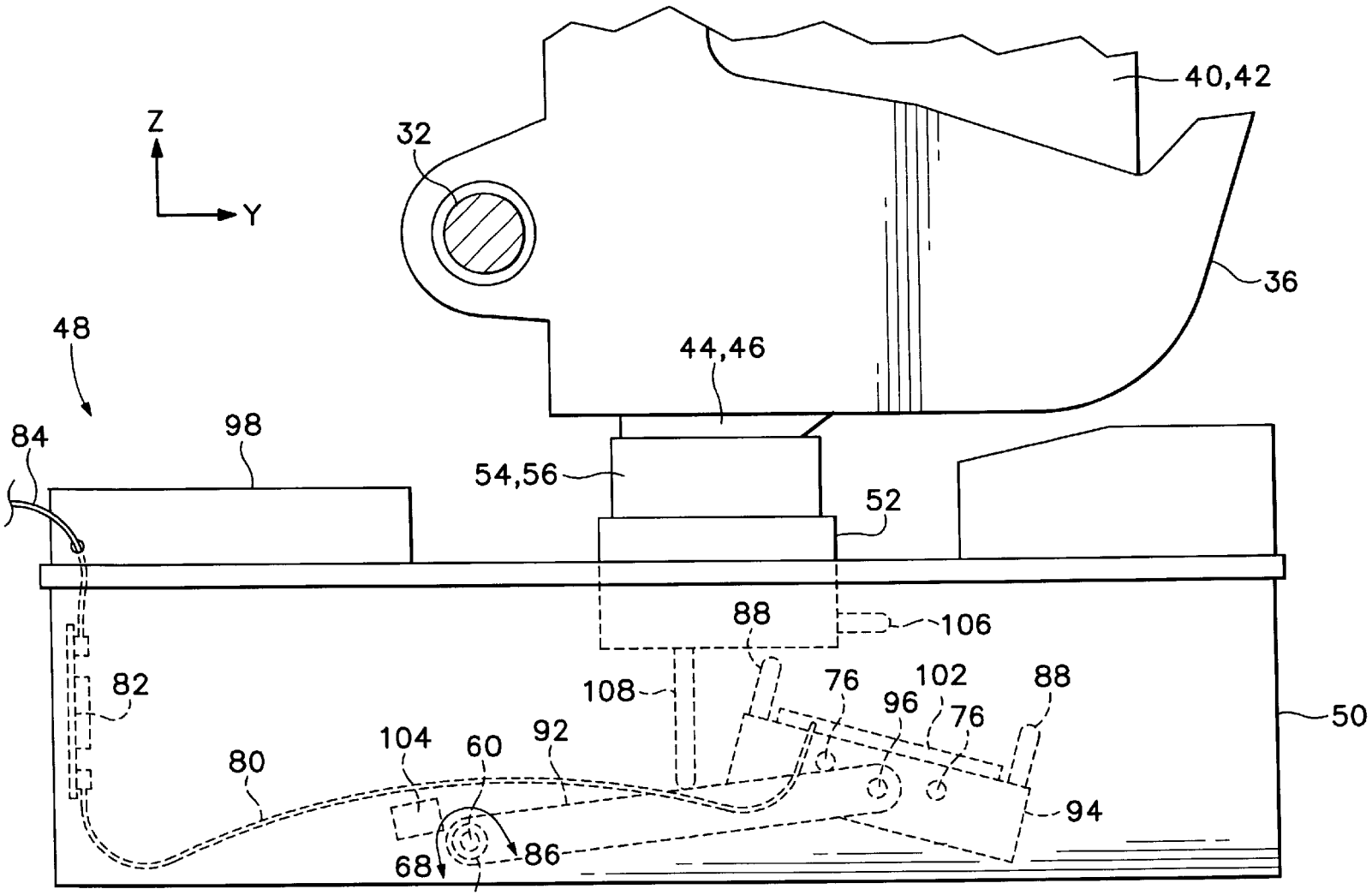
FIG. 8 is an enlarged side elevational view of the service station of FIG. 6, shown with a servicing sled in a servicing position.
Figure 9:
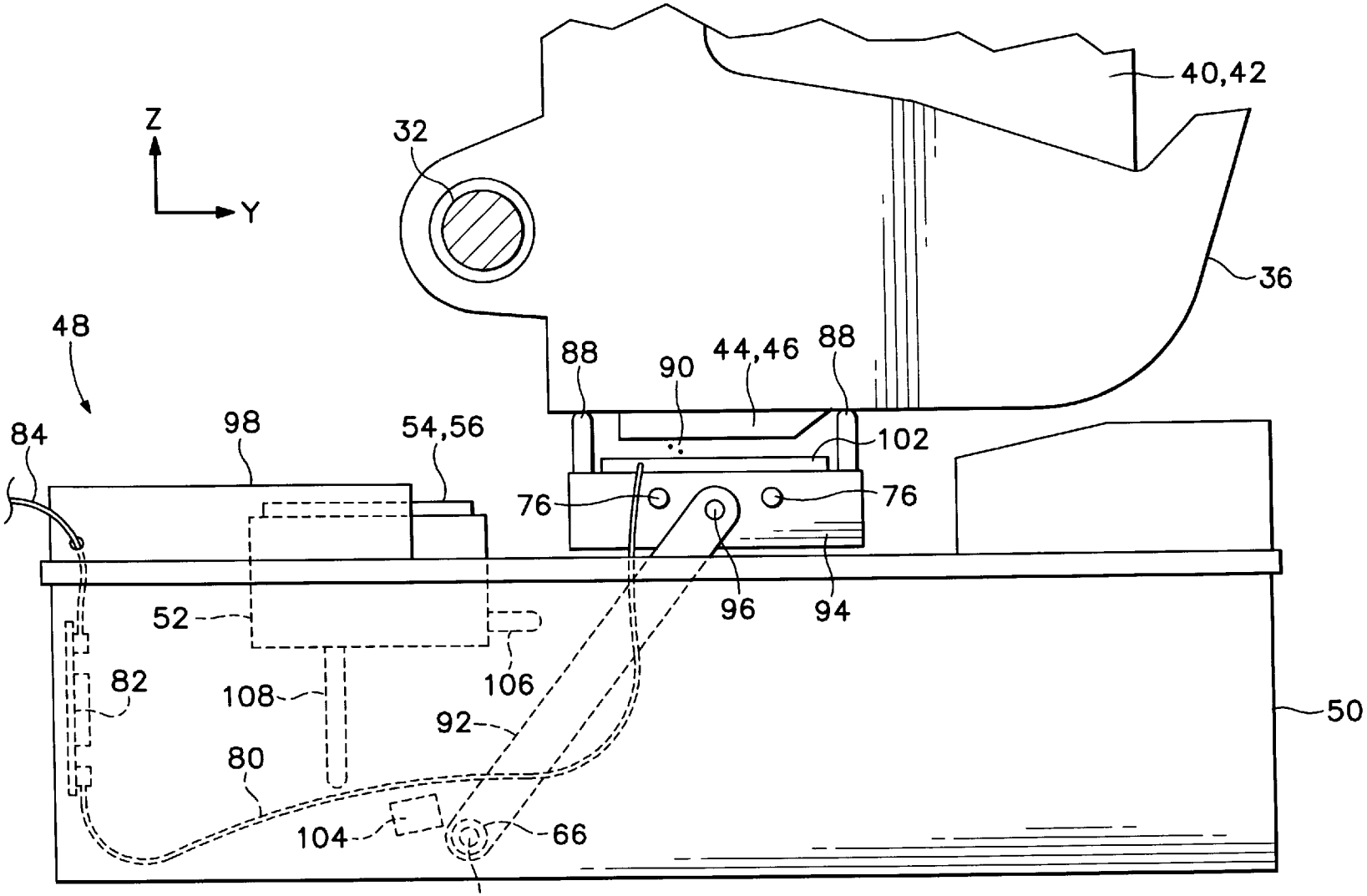
FIG. 9 is an enlarged side elevational view of the service station of own with an ink drop detection target in a measurement position.

Alternatively, when printhead 44, 46 servicing is complete, as shown in FIG. 8, if an electrostatic drop detection measurement is desired, the printhead carriage 36 can be left in position over the service station 48, and the servicing pallet 52 may then be withdrawn in the negative Y-axis position to a semi-retracted position as shown in FIG. 9. In moving to this semi-retracted position shown in FIG. 9, the linkage arms 92 and target holder 94 rotate in a counter-clockwise direction 68 around pivot post 60 until standoffs 88 engage the printheads 44, 46.

The standoffs 88 control the PEZ ("Pen to Electrostatic drop detector in the Z-direction") spacing from the printheads 44, 46 to the electrostatic target 102, and minimize the measurement tolerance variation in a similar fashion to the embodiment shown in FIG. 5 and described above. Once the printheads 44, 46 are properly spaced from the electrostatic target 102, the controller 26 causes ink droplets 90 to be fired from printhead 44, 46 onto the target 102. An electrical drop detect signal is generated by the ink droplets 90 as they contact the target 102, and this signal is captured by the electronics of electrostatic drop detector PCA 82. The drop detect signal is then analyzed by controller 26 to determine whether or not various nozzles of printhead 44, 46 are spitting ink properly or whether they are clogged. A preferred method of analyzing signals from an electrostatic target ink drop detector is shown in U.S. Pat. No. 6,086,190, also assigned to the present assignee, the Hewlett-Packard Company. Based on the determination made by the controller 26 as to whether each nozzle is functioning properly, the controller 26 may adjust the print masks to substitute functioning nozzles for any malfunctioning nozzles to provide consistent high-quality printed output while still using a printhead with permanently clogged nozzles.

In order to ensure that a reliable measurement may be made by the ink drop detector 58, it is desirable to prevent the build-up of dried ink deposits on the target 102 after a measurement or series of measurements have been made. Conductive absorbent target 102 is pretreated with a conductive solvent which is selected to dissolve and absorb the ink droplets 90 which contact the target 102, thereby reducing the likelihood that ink deposits may accumulate over time. Thus, the embodiment of an electrostatic drop detector 58 illustrated in FIGS. 6–9 may be constructed without additional hardware to clean and scrape the target 78 while still having long life and high reliability.

After the desired number of drop detection measurements are taken, the servicing pallet 52 may then be moved in the positive Y-axis direction to the pre-servicing position. The target standoffs 88 disengage the printheads 44, 46, and linkage arms 92 and target holder 94 move clear of the path traveled by the printhead carriage 36 when in motion. The printhead carriage 36 may then be moved in the positive X-axis direction towards the printzone 30, and then pallet 52 may be moved back in the negative Y-axis direction to the retracted position of FIG. 7. When the pallet 52 is in the retracted position of FIG. 7, the linkage arms 92 and target holder 94 are in the rearward non-measurement position, and the printhead carriage 36 is free at this point to move back to the servicing region 38 for spitting or to move to the printzone 30 for printing.

An electrostatic ink drop detector 58 enables a printing mechanism to reliably gather ink drop detection readings without the need for a cleaning mechanism to clean the target surface, while minimizing the effect of spacing variation due to part tolerances in order to provide users with consistent, high-quality, and economical inkjet output despite printheads 44, 46 which may clog over time. In discussing various components of the ink drop detector 58 and the service station 48, various benefits have been noted above.

It is apparent that a variety of other structurally equivalent modifications and substitutions may be made to construct an ink drop detector according to the concepts covered herein depending upon the particular implementation, while still falling within the scope of the claims below.

We claim:

1. An apparatus for detecting ink droplets ejected from ink drop generators, comprising:

a target holder;

a conductive absorbent target supported by the target holder;

standoffs extending from the target holder; and an actuator for moving the target holder towards the ink drop generators such that the standoffs space the target from the ink drop generators.

2. An apparatus according to claim 1, wherein:

the ink drop generators are organized in a drop generation plane; and the target lies in a target plane substantially parallel to the drop generation plane when the standoffs space the target from the ink drop generators.

3. An apparatus according to claim 2, wherein the actuator comprises a drop generator servicing pallet.

4. An apparatus according to claim 3 further comprising:

a frame;

a plurality of target pivot points, coupled to the target, the plurality of target pivot points lie in a substantially straight line, creating a target pivot axis;

a plurality of linkage arms, each having a first end and a second end, wherein the first end of each linkage arm pivotally supports the target at one of the target pivot points such that the target is free to rotate, at least through an arc, about the target pivot axis when hold by the linkage arms;

at least one pivot post, supported by the frame, wherein the second end of each linkage arm is pivotally supported by at least one pivot post; and a spring element which biases the linkage arms in a rotational direction around at least one pivot post.

5. An apparatus according to claim 4 wherein the spring element biases at least one of the linkage arms against the servicing pallet.

6. An apparatus according to claim 5 wherein:

movement of the servicing pallet from a retracted position towards the linkage arms creates a force great enough to overcome the force applied to the linkage arms by the spring element, thereby moving the linkage arms in a first direction; and movement of the servicing pallet away from the linkage arms, towards the retracted position, allows the spring element to maintain contact between the linkage arms and the servicing pallet, thereby moving the linkage arms in a second direction.

7. An apparatus according to claim 6 wherein the movement of the servicing pallet is substantially inline with the linkage arms.

8. An apparatus according to claim 7 further comprising at least one pallet arm coupled to the servicing pallet, wherein the at least one pallet arm is a portion of the servicing pallet which contacts the linkage arms.

9. An apparatus according to claim 6, wherein the movement of the servicing pallet is offset from the linkage arms.

10. An apparatus according to claim 9 further comprising at least one pallet arm coupled to the servicing pallet, wherein the at least one pallet arm is a portion of the servicing pallet which contacts the linkage arms.

11. An apparatus for detecting ink droplets ejected from ink drop generators, comprising:

a target holder;

a conductive absorbent target supported by the target holder;

standoffs extending from the target holder; and means for moving the target holder towards the ink drop generators such that the standoffs space the target from the ink drop generators.

12. An apparatus according to claim 11, wherein:

the ink drop generators are organized in a drop generation plane; and the target lies in a target plane substantially parallel to the drop generation plane when the standoffs space the target from the ink drop generators.

13. A method of ink drop detection comprising:

moving a conductive absorbent target towards an ink drop generator;

spacing the target from the ink drop generator with standoffs; and ejecting at least one drop of ink from the ink drop generator onto the target.

14. A method of ink drop detection according to claim 13 wherein moving a conductive absorbent target comprises:

translating a drop generator servicing pallet; and actuating the target towards the ink drop generator through translation of the pallet.

15. A printing mechanism, comprising:

a printhead having drop generators for selectively ejecting ink; and an ink drop sensor for detecting ink droplets ejected from the ink drop generators, comprising:

target holder;

a conductive absorbent target supported by the target holder;

standoffs extending from the target holder, and an actuator for moving the target holder towards the ink drop generators such that the standoffs space the target from the ink drop generators.

16. A printing mechanism according to claim 15, wherein:

the ink drop generators are organized in a drop generation plane; and the target lies in a target plane substantially parallel to the drop generation plane when the standoffs space the target from the ink drop generators.

17. A printing mechanism according to claim 16, wherein the actuator comprises a drop generator servicing pallet.

18. A printing mechanism according to claim 17 further comprising:

a frame;

a plurality of target pivot points, coupled to the target, the plurality of target pivot points lie in a substantially straight line, creating a target pivot axis;

a plurality of linkage arms, each having a first end and a second end, wherein the first end of each linkage arm pivotally supports the target at one of the target pivot points such that the target is free to rotate, at least through an arc, about the target pivot axis when held by the linkage arms;

at least one pivot post, supported by the frame, wherein the second end of each linkage arm is pivotally supported by at least one pivot post; and a spring element which biases the linkage arms in a rotational direction around at least one pivot post.

19. A printing mechanism according to claim 18 wherein the spring element biases at least one of the linkage arms against the servicing pallet.

20. A printing mechanism according to claim 19 wherein:

movement of the servicing pallet from a retracted position towards the linkage arms creates a force great enough to overcome the force applied to the linkage arms by the spring element, thereby moving the linkage arms in a first direction; and movement of the servicing pallet away from the linkage arms, towards the retracted position, allows the spring element to maintain contact between the linkage arms and the servicing pallet, thereby moving the linkage arms in a second direction.

21. A printing mechanism according to claim 20 wherein the movement of the servicing pallet is substantially inline with the linkage arms.

22. A printing mechanism according to claim 21 further comprising at least one pallet arm coupled to the servicing pallet, wherein the at least one pallet arm is a portion of the servicing pallet which contacts the linkage arm.

23. A printing mechanism according to claim 20, wherein the movement of the servicing pallet is offset from the linkage arms. drop generators, comprising:

a target holder;

a conductive absorbent target supported by the target holder;

standoffs extending from the target holder, and means for moving the target holder towards the ink drop generators such that the standoffs space the target from the ink drop generators.

24. A printing mechanism according to claim 23 further comprising at least one pallet arm coupled to the servicing pallet, wherein the at least one pallet an is a portion of the servicing pallet which contacts the linkage arms.

* * * * *

UNITED STATES PATENT AND TRADEMARK OFFICE

CERTIFICATE OF CORRECTION

PATENT NO. : 6,550,887 B2
DATED : April 22, 2003
INVENTOR(S) : Therien et al.

It is certified that error appears in the above-identified patent and that said Letters Patent is hereby corrected as shown below:

Column 4,
Line 5, after "of" insert -- Fig. 6 sh --;
Line 15, delete "others" and insert in lieu thereof -- other --;
Line 20, delete "formt" and insert in lieu thereof -- format --;
Line 22, delete "concept" and insert in lieu thereof -- concepts --;
Line 34, delete "beign" and insert in lieu thereof -- being --;
Line 36, after "such as" delete "a";

Column 5,
Line 27, delete "from" and insert in lieu thereof -- form --;

Column 14,
Line 35, after "arms" delete ", drop generators, comprising:
a target holder;

a conductive absorbent target supported by the target holder;

standoffs extending from the target holder, and means for moving the target holder towards the ink drop generators such that the standoffs space the target from the ink drop generators.";
Line 46, delete "an" and insert in lieu thereof -- arm --.

Signed and Sealed this

Twenty-seventh Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,550,887 B2
APPLICATION NO. : 09/915461
DATED : April 22, 2003
INVENTOR(S) : Therien et al.

It is certified that error appears in the above-identified patent and that said Letters Patent is hereby corrected as shown below:

On the Title page of the patent, Item (73) Assignee:

delete "Christopher B. Miller, Palo Alto CA (US)" and insert therefor, --Hewlett-Packard Company, Box 272400, Intellectual Property Administration, Fort Collins, CO 80527-2400--

Signed and Sealed this

Second Day of October, 2007

JON W. DUDAS
*Director of the United States Patent and Trademark Office*